US005543891A

United States Patent [19]

Setoriyama

[11] Patent Number: 5,543,891

[45] Date of Patent: Aug. 6, 1996

[54] ELECTROPHOTOGRAPHIC IMAGE FORMING APPARATUS WITH A PROCESS CARTRIDGE MOUNTING FEATURE

[75] Inventor: Takeshi Setoriyama, Yokohama, Japan

[73] Assignee: Canon Kabushiki Kaisha, Tokyo, Japan

[21] Appl. No.: 345,377

[22] Filed: Nov. 18, 1994

Related U.S. Application Data

[60] Continuation of Ser. No. 50,594, Apr. 22, 1993, abandoned, which is a division of Ser. No. 824,530, Jan. 23, 1992, abandoned.

[30] Foreign Application Priority Data

Jan. 25, 1991 [JP] Japan ..... 3-023846
Mar. 12, 1991 [JP] Japan ..... 3-070431

[51] Int. Cl.[6] ..... G03G 21/00

[52] U.S. Cl. ..... 355/200

[58] Field of Search ..... 355/200, 210, 355/245, 260

[56] References Cited

U.S. PATENT DOCUMENTS

| | | | |
|---|---|---|---|
| 4,556,308 | 12/1985 | Hoppner et al. | 355/200 |
| 4,785,319 | 11/1988 | Fujino et al. | 346/160 |
| 4,862,212 | 8/1989 | Tanzawa et al. | 355/260 X |
| 4,873,548 | 10/1989 | Kobayashi et al. | 355/200 |
| 4,908,661 | 3/1990 | Iwata et al. | 355/210 X |
| 4,947,208 | 8/1990 | Komatsu et al. | 355/200 |
| 4,985,731 | 1/1991 | Sakakura et al. | 355/210 |
| 5,099,280 | 3/1992 | Takemoto et al. | 355/210 |
| 5,105,221 | 4/1992 | Takahashi et al. | 355/210 |
| 5,115,272 | 5/1992 | Ohmori et al. | 355/200 |

FOREIGN PATENT DOCUMENTS

| | | |
|---|---|---|
| 0163486 | 12/1985 | European Pat. Off. . |
| 0333106 | 9/1989 | European Pat. Off. . |
| 0381401 | 8/1990 | European Pat. Off. . |
| 0406149 | 1/1991 | European Pat. Off. . |
| 2611930 | 9/1988 | France . |
| 61-195073 | 8/1986 | Japan . |
| 58-143355 | 8/1993 | Japan . |
| 2197258 | 5/1988 | United Kingdom . |

OTHER PUBLICATIONS

Patent Abstract of Japan, vol. 7, No. 262, Nov. 22, 1983.
Patent Abstract of Japan, vol. 11, No. 027, Jan. 1987.

*Primary Examiner*—Fred L. Braun
*Attorney, Agent, or Firm*—Fitzpatrick, Cella, Harper & Scinto

[57] ABSTRACT

An image forming apparatus uses a process cartridge detachable from the main body of the apparatus, wherein the process cartridge has an image bearing member and a process device for performing a process on the image bearing member. The image forming apparatus has a frame including a circular arc-shaped guiding portion for guiding the process cartridge toward a predetermined mounted portion. A drive transmission transmits a driving force to the process cartridge mounted in the predetermined mounted position, an optical device illuminates the image bearing member with information light and a transfer device transfers a toner image from the image bearing member onto the recording medium. In addition, a conveyor conveys the recording medium through the frame.

73 Claims, 5 Drawing Sheets

ELECTROPHOTOGRAPHIC IMAGE FORMING APPARATUS WITH A PROCESS CARTRIDGE MOUNTING FEATURE

This application is a continuation of application Ser. No. 08/050,594, filed on Apr. 22, 1993, now abandoned, which is a division of application Ser. No. 07/824,530, filed on Jan. 23, 1992, now abandoned.

BACKGROUND OF THE INVENTION

1. Field of the Invention

The present invention relates to an image forming apparatus which uses an electrophotographic method, and more particularly, to an image forming apparatus, such as an electrophotographic printer, a facsimile apparatus, or the like, which uses a laser beam or a light-emitting diode (LED) array as a light source.

2. Description of the Related Art

One type of the above-described image-forming apparatus is divided into an upper-case portion and a lower-case portion. As shown in FIG. 4, an upper case B is openable and closable relative to a lower case A around a hinge 30. The lower case A contains a sheet feed means a, an image transfer means b, a plurality of transfer-material conveying means c, a driving means (not shown), a fixing means d, and the like. The upper case B contains a cartridge guiding/holding means e for retaining an image-forming process cartridge 7, an optical system means (an exposing light source means f, such as a laser-beam scanner or the like), a sheet discharge means g, and the like. By opening the upper case B around the hinge 30, the acts of mounting and demounting the process cartridge 7, removing jammed transfer material, and the like are performed.

However, such an apparatus has a disadvantage because the upper and lower cases are independently configured. Consequently, it is difficult to provide positional accuracy and alignment, i.e., parallelism among the several components and units. Particularly, in a transfer portion, the positional relationship between the images on a recording material and a photosensitive member is often skewed, deviated, or tilted. It is also difficult to provide positional accuracy between a driving member within the process cartridge for receiving the driving source of the photosensitive member and the gears of the driving means in the lower case. Hence, the center distance between the gears deviates, causing unevenness in the rotation speed of the photosensitive member. As a result, unevenness in pitch, i.e., unevenness in the distance between adjacent scanning lines on the photosensitive member occurs in the image. In an apparatus wherein the frame of the main body of the apparatus is configured by facing side plates made of sheet metal which are connected by individual metal stays, the side plates may become twisted or tilted with respect to each other. Accordingly, it is difficult to increase the dimensional stability of the frame. Moreover, a frame made of sheet metal often resonates due to vibration caused by the driving system, causing an inferior image, such as a blurred image, or the like.

SUMMARY OF THE INVENTION

The present invention has been made in consideration of the above-described problems present in conventional apparatuses.

It is an object of the present invention to provide an image forming apparatus which can very precisely position the respective units relative to one another and also increase the rigidity of the frame of the apparatus, whereby picture quality, reliability, and the like are increased.

It is another object of the present invention to reduce the size of the main body of an image forming apparatus, whereby it is possible to economize materials for the several components and to reduce the size of the apparatus.

It is still another object of the present invention to provide a structure for loading a process cartridge compatible with a reduction in the size of the main body of an image forming apparatus.

The invention in one aspect pertains to an electrophotographic image forming apparatus comprising an electrophotographic photosensitive member, an image forming means for forming a toner image on said electrophotographic photosensitive member, a transfer-material feeding means, a transfer-material conveying means, an image transfer means for transferring the toner image onto the transfer material, an image fixing means for fixing the toner image on the transfer material, and a structural frame for a main body of the apparatus, comprising wall members having plate-like portions being parallel with each other and connecting members for connecting said wall members to each other, said wall members and said connecting members being configured by a monobloc forming method using a resinous material, wherein said image forming means, said transfer-material feeding means, said transfer-material conveying means, said image transfer means, and said fixing means are mounted on said structural frame.

The invention in a further aspect pertains to an electrophotographic image forming apparatus comprising a process cartridge detachable to a main body of the appartus, comprising at least one of an electrophographic photosensitive member and process means for forming an image on said photosensitive member, provided as one unit, transfer-material feeding means, transfer-material conveying means, image transfer means for transferring the toner image onto the transfer material, image fixing means for fixing the toner image on the transfer material, and a structural frame of a main body of the apparatus comprising wall members having plate-like portions being parallel with each other and connecting members for connecting said wall members to each other, said wall members and said connecting members being configured by a monobloc forming method using a resinous material, wherein said process cartridge, said transfer-material feeding means, said transfer-material conveying means, said image tranfer means, and said image fixing means are mounted on said structural frame.

The monobloc forming method means that the frame 39 is made as a single structure as opposed to a structure comprising several parts secured by fasteners, adhesives and the like.

The invention in yet another aspect pertains to an electrophotographic image forming apparatus comprising a process cartridge detachable from a main body of the apparatus, comprising a plurality of guiding projections forward therein, and at least one of an electrophotographic photosensitive member and process means for forming an image on said photosensitive member, provided as one unit, transfer-material feeding means, transfer-material conveying means, image transfer means for transferring the toner image onto the transfer material, image fixing means for fixing the toner image on the transfer material, and a structural frame of a main body of the apparatus comprising wall members having plate-like portions being parallel with each other, and groove portions formed in said structural frame, said groove portions defining a curve toward a predetermined process cartridge mounted position, wherein said process cartridge is mounted at the predetermined mounted position provided in said structural frame by engaging said guiding projections with said groove portions.

DETAILED DESCRIPTION OF THE PREFERRED EMBODIMENT

A preferred embodiment of the present invention will now be explained with reference to the drawings.

Figure 1:
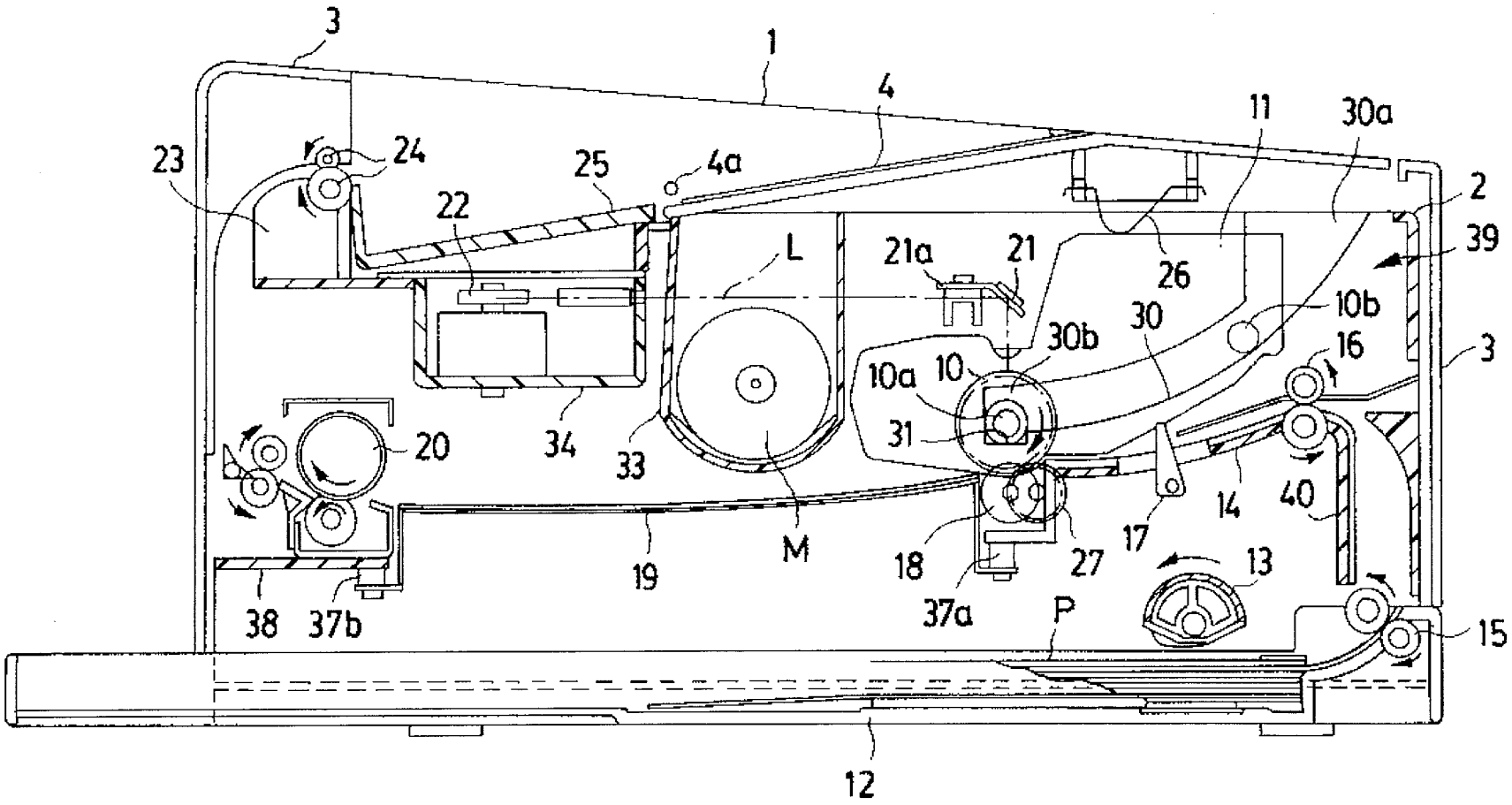
FIG. 1 is a cross-sectional view of a laser-beam printer apparatus according to one preferred embodiment of the present invention.

FIG. 1 is a cross-sectional side view of a laser-beam printer. In FIG. 1, there is shown a process cartridge 11. As shown in detail in FIG. 5, the process cartridge 11 includes a photosensitive drum 10 which rotates about a shaft 10*a*, serving as an image bearing member, a charger 101, a cleaning unit 103, and the like, provided in one unit. Again with reference to FIG. 1, a first conveying guide 14, first and second pairs of conveying rollers 15 and 16, respectively, a registration sensor 17 for adjusting timing, and an image transfer roller 18 are disposed from the right to the left of the figure below the process cartridge 11 at a side upstream in the direction of conveying a sheet of a transfer material. A second conveying guide 19, and a fixing unit 20 including a heating roller are disposed at a downstream side. A reflecting mirror 21, serving as a light guiding means, is disposed above a portion of the process cartridge 11. A laser-beam scanner 22, serving as a light source means, is disposed in parallel with the process cartridge 11. A discharge guide 23, a pair of discharge rollers 24, and a discharge tray 25 are disposed at the left of the process cartridge 11. A feed cassette 12 for receiving sheets of a transfer material P, and a feed roller 13 are disposed below the first and second conveying guides 14 and 19 to form an upper case S-shaped conveyance path.

When an image light L exposes the photosensitive drum 10 uniformly charged by the charger 101 by the laser-beam scanner 22 and the reflecting mirror 21, an electrostatic latent image is formed on the photosensitive drum 10. The electrostatic latent image is developed by the developing unit 102 in accordance with the rotation of the photosensitive drum 10 to become a toner image, which is then transferred onto a sheet of a transfer material P by the image transfer roller 18. After the completion of the image transfer operation, the photosensitive drum 10 is cleaned by the cleaning unit 103 to be ready for a subsequent image formation.

A sheet of the transfer material P taken out from within the feed cassette 12 by the feed roller 13 is moved along the first conveying guide 14 to the second pair of conveying rollers 16 via the first pair of conveying rollers 15. The timing of the sheet is then adjusted by the second pair of conveying rollers 16 and the registration sensor 17, and the sheet is conveyed to the photosensitive drum 10. The sheet on which the toner image is transferred from the photosensitive drum 10 by the image transfer roller 18 is conveyed along the second conveying guide 19 to the fixing unit 20, where the toner image is fixed by heating. The sheet is then placed onto the discharge tray 25 via the discharge guide 23 and a pair of discharge rollers 24.

Figure 3:
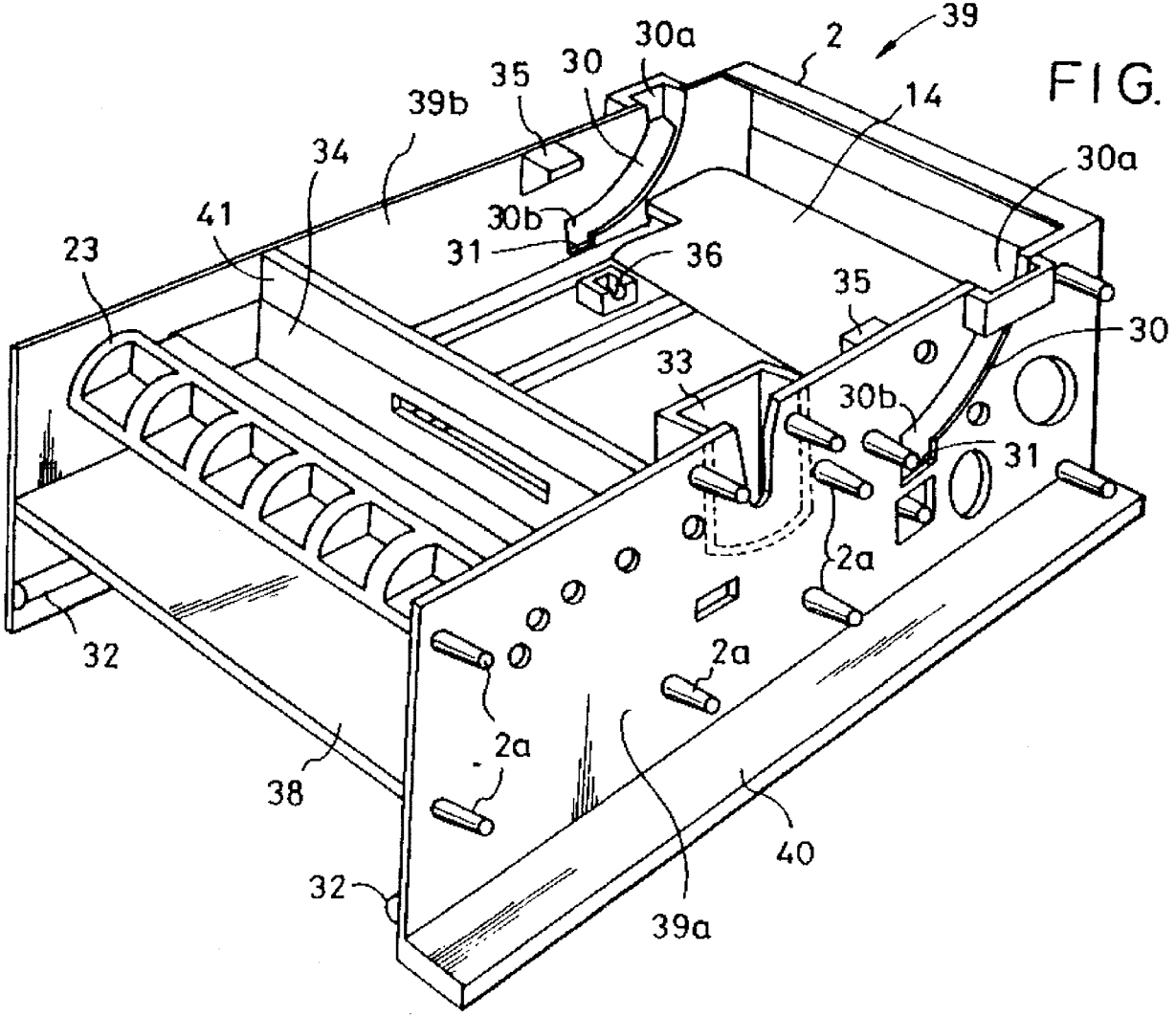
FIG. 3 is a perspective view of a structural frame of the present invention.
Figure 4:
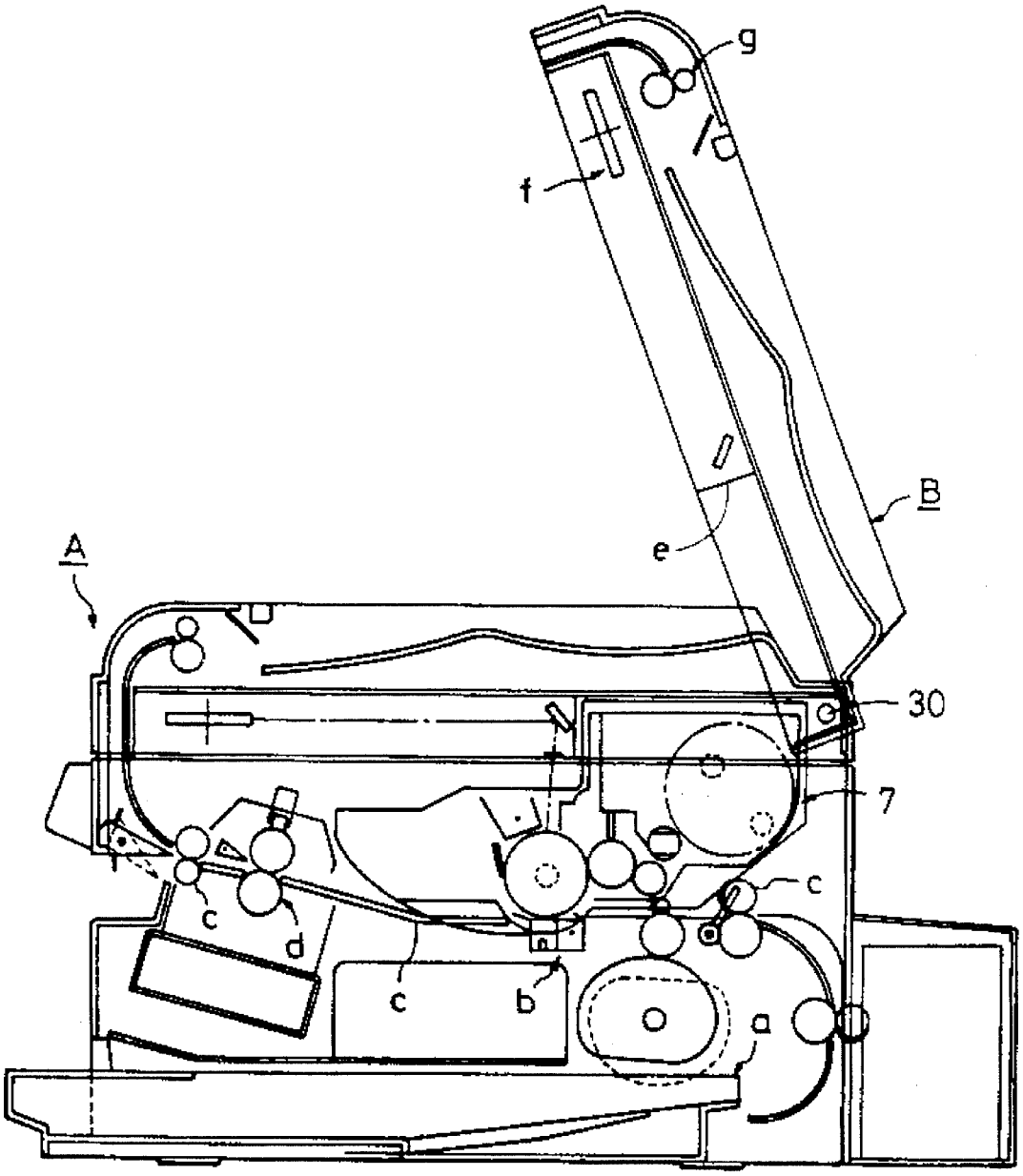
FIG. 4 is a diagram illustrating the configuration of a laser-beam printer apparatus to which the structural frame of the present invention is not applied.

Next, an explanation of the manner in which the units are supported within a main body 1 of the printer, and the external configuration of the main body 1 will be provided. As shown in FIG. 3, the main body 1 includes a structural main frame 39, which supports substantially all of the units used for image formation. The frame 39 is three-dimensionally configured using a material made of a resin, such as polycarbonate (PC), polyphenylene oxide (PPO, represented by Noryl), acrylonitrile butadiene styrene (ABS), high impact styrol (HIPS) or the like, containing about 30–50% of glass fibers, carbon fibers or the like in consideration of their rigidity, dimensional stability, heat-resisting properties and the like. The frame 39 comprises a high-rigidity and high-precision monobloc injection-molded product. Accordingly, respective units are very precisely positioned and supported in the frame 39. Particularly, since principal parts of the first conveying guide 14 and the discharge guide 23 which determine the basic arrangement of units are configured by the frame 39, positional accuracy of respective units is further increased.

As shown in FIG. 3 and with further reference to FIG. 1, guide unit 32 for guiding and holding the feed cassette 12, a motor holding unit 33 for holding a main motor M, cartridge guide slots 30 (to be described later) for guiding and holding the process cartridge 11, a holding unit 34 for the laser-beam scanner 22, a holding unit 35 for the reflecting mirror 21, a holding unit 36 for the image transfer roller 18, holding units 37*a* and 37*b* for the conveying guide 19, holding unit 38 for the fixing unit 20, and positioning/holding units for the feed roller 13, the conveying rollers 15 and 16 and the discharge rollers 24 are integrally formed on the frame 39. Hence, these units are very precisely positioned and secured relative to one another.

Since a guide unit 40 for a portion from the feed portion to the transfer portion provided at a lower portion of the apparatus is formed integrally with the frame 39, the positional relationship between a transfer nip portion produced by the pressure contact between the photosensitive drum 10 and the image transfer roller 18 and the sheet of the recording material P is always stable with high precision. Accordingly, it is possible to obtain a clear image not having deviation, tilt or the like which may occur during the transfer operation.

Since the discharge guide 23 for the sheet of the recording material P after the fixing operation is also formed integrally with the frame 39, the positional relationship between the fixing unit 20 and the discharge guide 23, and between the discharge guide 23 and the discharge rollers 24 are also maintained with high precision. As a result, it is possible to prevent the sheet of the recording material P from being subjected to curling or the like by thermal fixing and from being jammed at the discharge guide 23. Accordingly, the reliability of the apparatus is increased.

Since the laser-beam scanner 22, the reflecting mirror 21 and the photosensitive drum 10 are positioned and secured on the frame 39, the respective components may be easily aligned with one another. Furthermore, the positional accuracy of the laser light projected onto the photosensitive drum 10 is increased, and the positional accuracy of an image on the sheet of the recording material P is also increased.

The frame 39 has a rigid three-dimensional structure, since wall-like frames 39*a* and 39*b* having planes parallel with each other constituting the side plates are connected as one body by connecting units 2, 14, 34, 38, 40 and 41 integrally formed with the frames 39*a* and 39*b*. Hence, the present embodiment has the advantage that the frame 39 has high rigidity. In addition, oscillation generated from the laser-beam scanner 22 and the main motor M will be easily attenuated, and resonance hardly occurs in the frame 39.

Furthermore, since problems, such as failures in image formation, sheet feeding and the like, can be previously found by inspecting only a single product, i.e., the frame 39, the present embodiment also has an advantage in that appropriate countermeasures for the problems can be executed at an earlier stage, whereby productivity will be increased.

As described above, by simplifying the configuration of an apparatus as much as possible and reducing the size of the apparatus by increasing the degree of integration of units, and thereby concentrating substantially all functions necessary for image formation in the frame 39, it is possible to utilize a high-level injection molding technique to full advantage.

By using a conductive metal filler (such as stainless steel, copper or the like) mixed in the resin for the frame 39, it is possible to further increase the rigidity of the frame 39, and to provide a conductive property having a resistivity of 1 to 10 Ω/cm. It is thereby possible to use the frame 39 as a conventional conductive substrate, and to provide a shielding effect to prevent electric noise generated from a control substrate located within the apparatus from leaking outside the apparatus.

By mixing a rubber material having excellent elasticity, such as butadiene rubber, a rubber wherein the polarity of butadiene rubber is changed, or urethane-type rubber, in the resin material for the frame 39, it is possible to further improve the vibration damping property of the frame 39, and thereby to reduce unevenness in pitches. That is, by mixing other substances having various properties in the resin material for the frame 39, it is possible to provide the frame 39 with various composite functions.

As shown in FIG. 1, the outer circumferential portion of the structural frame 39 is covered with an outer cover 3 part of which is supported by a plurality of projections 2*a* (shown in FIG. 3) formed in the front and rear walls 39*a* and 39*b* of the frame 39. A cover 4 openable and closable around a support shaft 4*a* is mounted at an upper right portion of the frame 39. The process cartridge 11 is mounted on or demounted from the main body 1 of the apparatus-by opening the openable cover 4 in a counterclockwise direction (see FIG. 2). A pressing spring 26 for securing the process cartridge 11 is mounted on the cover 4.

Figure 2:
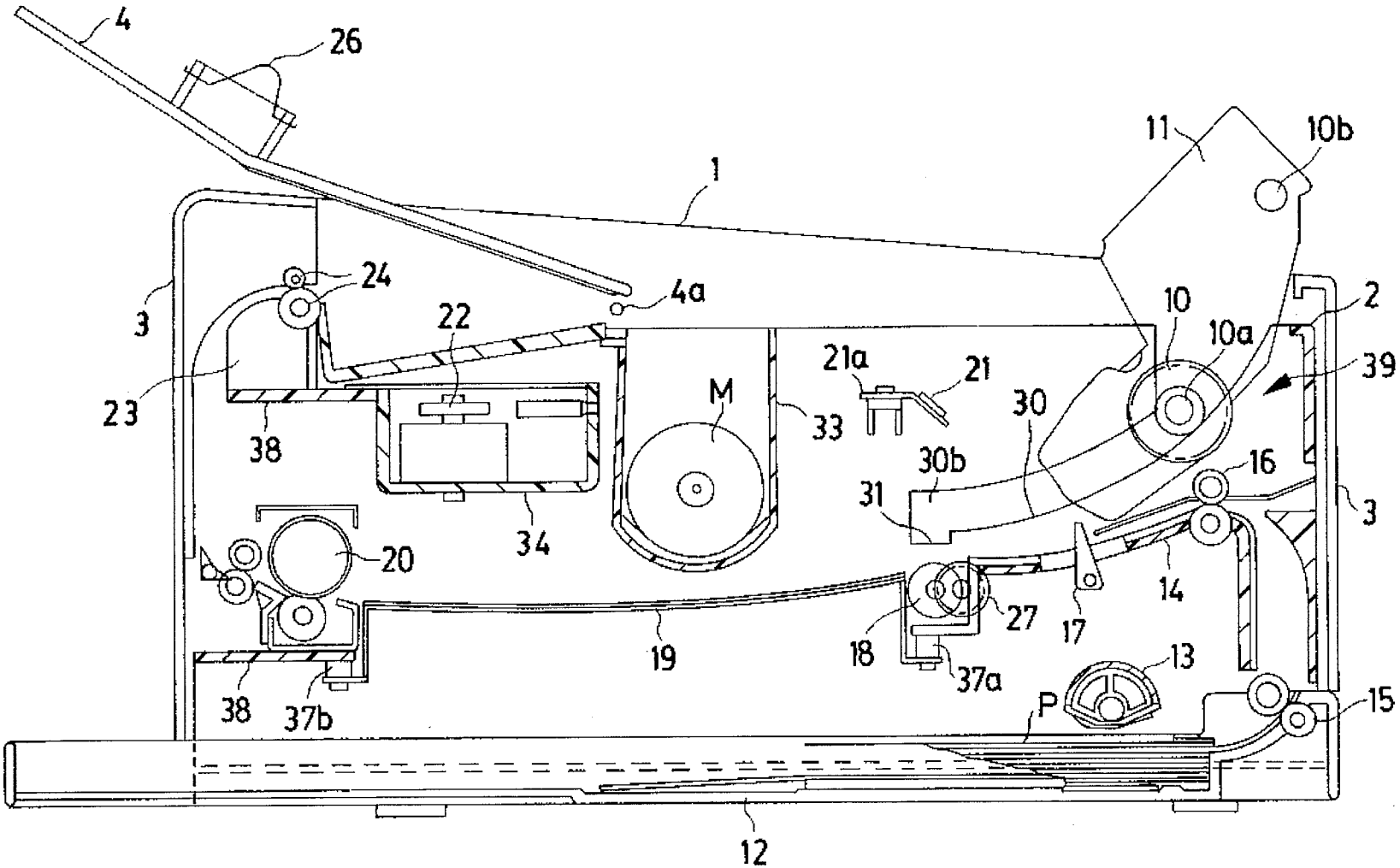
FIG. 2 is a diagram illustrating a state of mounting a process cartridge on the FIG. 1 apparatus.

Next an explanation regarding the manner in which the process cartridge 11 is mounted on or demounted from the main body 1 of the apparatus will be provided. As shown in FIGS. 1 through 3, guide grooves 30, 30 defining a curve for mounting/demounting the process cartridge 11 are formed in the front and rear walls 39*a* and 39*b* of the frame 39. The process cartridge 11 is mounted or demounted by engaging the drum shaft 10*a* of the photosensitive drum 10 extruding from the outer surfaces of the process cartridge 11 with the guide grooves 30, 30. The upper end portion (hereinafter termed insertion portions 30*a*, 30*a*) of the guide grooves 30, 30 are positioned immediately below the openable cover 4, and the lower end portions (hereinafter termed positioning portions 30*b*, 30*b*) are positioned between the reflecting mirror 21 and the transfer roller 18. The guide grooves 30, 30, the insertion portions 30*a*, 30*a* and the positioning portions 30*b*, 30*b* are formed to define a downwardly convex circular arc.

The positioning grooves 31, 31 which are slightly downwardly widened about 3 mm in the present embodiment are formed at the positioning portions 30*b*, 30*b* of the guide grooves 30, 30. By dropping the drum shaft 10*a* of the process cartridge 11 in the positioning grooves 31, 31, the process cartridge 11 is positioned with respect to the main body 1 of the apparatus.

Next, an explanation of the reason why the guide grooves 30, 30 for mounting/demounting the process cartridge 1 has the shape of a circular arc will be provided. The reflecting mirror 21 supported by the frame 39 via a holder 21*a* is provided above the photosensitive drum 10 within the process cartridge 11. A driving gear 27 for rotating, for example, the image transfer roller 18 and the photosensitive drum 10, and the like are disposed below the photosensitive drum 10. The driving gear 27 is disposed at a position more or less deviated from the photosensitive drum 10 so as not to raise the process cartridge 11 in a driving operation. The first and second conveying guides 14 and 19 for the sheet of the transfer paper P are substantially horizontally disposed at the right and left below the process cartridge 11, respectively. The registration sensor 17 and the second pair of conveying rollers 16 are disposed above the first conveying guide 14 in a state of more or less projecting toward the process cartridge 11.

Accordingly, it is necessary to prevent the process cartridge 11 from interfering with the reflecting mirror 21, the image transfer roller 18, the registration sensor 17, the second pair of conveying rollers 16, and the driving gear 27 in the main body 1 of the apparatus when the process cartridge 11 is mounted or demounted. For that purpose, the guide groove 30 must be formed in the shape of a circular arc. The shape of the circular arc is also suitable for facilitating the mounting and demounting of the process cartridge 11.

If the cover 4 is upwardly opened, as shown in FIG. 2, and the process cartridge 11 is downwardly pressed by engaging the drum shaft 10*a* of the process cartridge 11 with the insertion portions 30*a*, 30*a* (see FIG. 1) of the guide grooves 30, 30 of the frame 39, the process cartridge 11 is guided through the positioning portions 30*b*, 30*b* without interfering with other units while moving along the circular-arc locus guide grooves 30, 30. The drum shaft 10*a* of the process cartridge 11 is finally dropped within the positioning grooves 31, 31, whereby the process cartridge 11 is positioned within the main body 1 of the apparatus.

In this case, since the gear at the side of the process cartridge 11 and the driving gear 27 at the side of the main body 1 of the apparatus mesh with each other in accordance with the travel of the process cartridge 11 in the positioning grooves 31, 31, meshing of these gears is naturally and smoothly effected.

If the cover 4 is closed after positioning the process cartridge 11, the process cartridge 11 is downwardly pressed by the pressing spring 26 and is secured by the positioning grooves 31, 31. To take the process cartridge 11 out of the main body 1 of the apparatus, an operation which is the reverse of the above-described operation will be performed, whereby it is possible to smoothly take out the process cartridge 11 without interfering with surrounding structure and units.

As described above, in the present embodiment, since the process cartridge 11 is mounted on or demounted from the main body 1 of the apparatus along the guide grooves 30, 30 having the shape of a circular arc provided in the frame, it is possible to easily mount or demount the process cartridge 11, in addition the positional relationship between the process cartridge 11 and other units after final positioning is maintained with high precision.

Particularly, since the distance between the driving gear 27 supported on the structural frame 39 at the side of the main body 1 of the apparatus and the gear at the side of the process cartridge 11 can be very precisely maintained, uneven rotation of the photosensitive drum 10 will not occur, and a clear image will be obtained. Since the laser-beam scanner 22, the reflecting mirror 21 and the photosensitive drum 10 are positioned and secured on the frame 39, the respective units may be easily aligned with one another. Furthermore, the positional accuracy of the image light L projected onto the photosensitive drum 10 is increased, and the positional accuracy of an image on the sheet of the transfer material P is also increased. Accordingly, failures in transfer, such as positional deviation relative to the sheet of the transfer material P and the like, will not occur.

According to the cartridge-mounting structure of the present invention, since it is unnecessary to mount the process cartridge 11 and the like on the cover 4, the structure of the cover 4 is simplified, and the weight of the openable cover 4 is reduced. As a result, the operations of opening/closing the cover 4 become easier, and the operational feeling will be improved since the weight of the cover 4 remains constant.

That is, since the guide grooves in the structural frame for mounting/demounting the process cartridge are formed in the shape of a circular arc and the process cartridge is mounted/demounted along the grooves, the process cartridge will not interfere with other components when the process cartridge is mounted/demounted, and the mounting/demounting operation of the process cartridge becomes easier. Furthermore, since it is unnecessary to mount/demount the process cartridge while mounting it on, for example, a cover which can be upwardly opened and downwardly closed, the operation of the cover or the like becomes easier, and the structure of the cover or the like is simplified.

Figure 5:
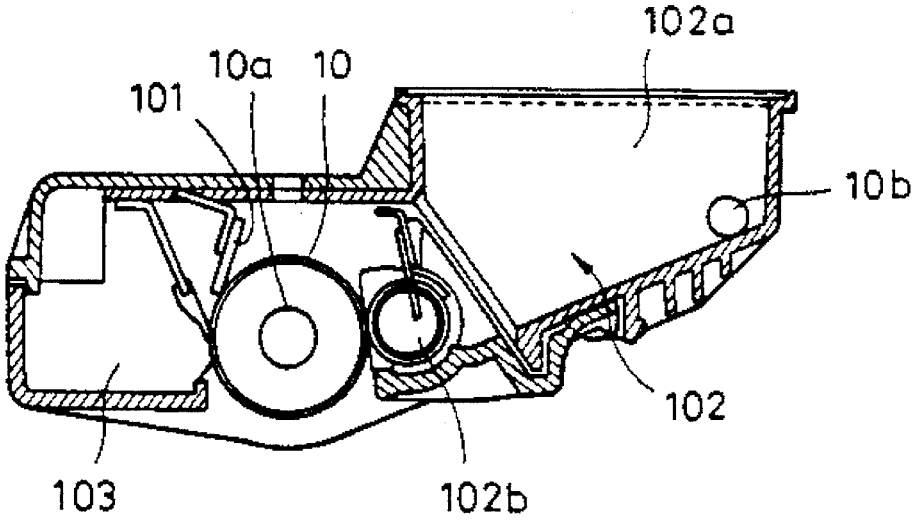
FIG. 5 is a cross-sectional view illustrating the process cartridge.
Figure 6:
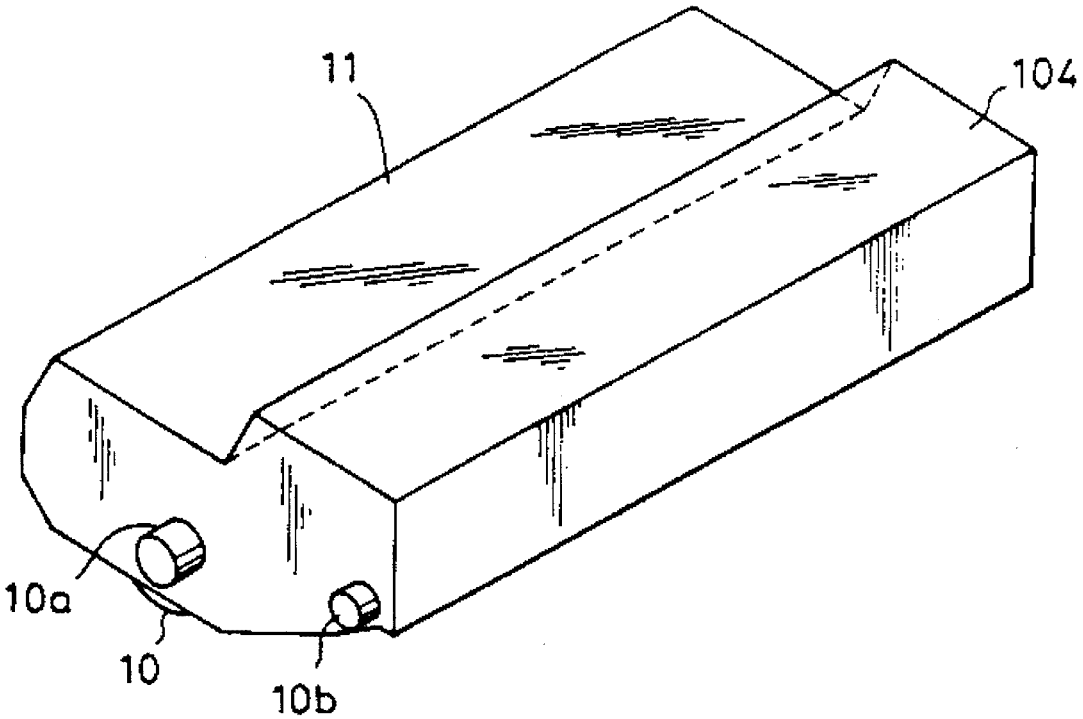
FIG. 6 is a perspective view of the process cartridge shown in FIG. 5.

FIG. 5 is a diagram illustrating the configuration of the above-described process cartridge 11. As described above, the process cartridge 11 includes the photosensitive drum 10, the charger 101, the developing unit 102 and the cleaning unit 103 as one integral body. A toner receiving unit **102*a* is provided at an upper portion of the developing unit 102. A developing roller 102*b* faces the drum 10. FIG. 6 shows the external appearance of the process cartridge 11. There are shown two projections 10*a* and 10*b* engaging the above-described positional grooves 31, 31. As described above, the projection 10*a* is the rotation shaft of the drum itself. The other projection 10*b* is formed by monobloc molding with an outer frame 104 of the process cartridge 11** made of resin.

Although, in the present invention, a charger, a developing unit, and a cleaning unit are provided as one body in a cartridge, the present invention may also be applied to cartridges having other conventionally-known structures wherein, for example, a developing unit is separately provided, only a developing unit can be taken out of a cartridge in a state of demounting the cartridge from the main body of the apparatus, and toner can be replenished in a developing unit.

The structural frame made by monobloc forming shown in FIG. 3 is not a prerequisite requirement for the groove mechanism for mounting the cartridge. However, if the structural frame shown in FIG. 3 is adopted, since positional accuracy is increased, the spaces among units are reduced, whereby the size of the entire apparatus is reduced. The cartridge can be mounted/demounted without interfering with other components as much as possible in the apparatus whose size is reduced. Hence, it can be said that the structural frame shown in FIG. 3 is a further effective configuration.

Although, in the above-described embodiment, the laser-beam scanner 22 and the reflecting mirror 21 are used as means for irradiating information light and light guiding means, respectively, the present invention is not limited to these components. For example, an LED head array may, of course, be used as the light irradiating means, or a lens made of optical fibers having graded refractive indices, a liquid-crystal shutter, or the like may be used as the light guiding means. The LED head array may be disposed at the position of the scanner 22, and a condenser lens may be disposed between the LED array and the reflecting mirror 21. Alternatively, a combination of the LED head array and a condenser lens may be disposed at the position of the reflecting mirror 21.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus, to which a process cartridge is detachably mountable, the process cartridge having an electrophotographic photosensitive member and process means for acting on the electrophotographic photosensitive member, for forming an image on a recording medium, said image forming apparatus comprising:

an integrally-formed frame having an arc-shaped guiding portion for guiding the process cartridge toward a mounted position, said arc-shaped guiding portion extending from an upper end portion to a lower end portion;

drive transmission means for transmitting a driving force to the process cartridge mounted in the mounted position;

optical means for illuminating the electrophotographic photosensitive member of the process cartridge mounted in the mounted position with information light;

transfer means for transferring a toner image formed on the electrophotographic photosensitive member of the process cartridge mounted in the mounted position onto the recording medium; and conveying means for conveying the recording medium through said frame, said frame comprising (i) integrally-formed optical holding means for fixedly holding said optical means above the lower end portions of first and second arc-shaped guiding portions, (ii) integrally-formed transfer holding means for fixedly holding said transfer roller below the lower end portions of said first and second arc-shaped guiding portions, (iii) integrally-formed guiding means for guiding the recording medium from a paper supply to said transfer roller, (iv) integrally-formed fixing holding means for fixedly holding fixing means for fixing an image on the recording medium, and (v) integrally-formed discharge guiding means for guiding the recording medium from the fixing means to a discharge tray.

2. An apparatus according to claim 1, wherein the mounted position has a positional groove, and the positional groove is coupled to said arc-shaped guiding portion.

3. An apparatus according to claims 1 or 2, wherein said arc-shaped guiding portion is curved toward a lower portion of a body of said image forming apparatus.

4. An apparatus according to claim 3, wherein said arc-shaped guiding portion comprises a guide groove which couples an insertion portion of the process cartridge with the mounted position in an arc which is convex downward.

5. An apparatus according to claim 1, wherein said arc-shaped guiding portion comprises a guide groove which couples an insertion portion of the process cartridge with the mounted position in an arc which is convex downward.

6. An apparatus according to claim 1, wherein said optical means comprises a mirror disposed above said arc-shaped guiding portion.

7. An apparatus according to claims 1 or 6, wherein said transfer means is disposed below said arc-shaped guiding portion.

8. An apparatus according to claim 7, wherein said transfer means comprises a transfer roller.

9. An apparatus according to claim 1, wherein said drive transmission means comprises a driving gear, and said driving gear meshes with a gear of the process cartridge.

10. An image forming apparatus according to claim 1, wherein the process cartridge mounted to the mounted position is supported at least in part by said arc-shaped guiding portion.

11. An image forming apparatus, to which a process cartridge is detachably mountable, the process cartridge having an electrophotographic photosensitive member and process means for acting on the electrophotographic photosensitive member, for forming an image on a recording medium, said image forming apparatus comprising:

(a) an integrally-formed frame with a first frame and a second frame being arranged opposite to each other, a first arc-shaped guiding portion for guiding the process cartridge toward a mounted position, arranged on said first frame, said first arc-shaped guiding portion extending from an upper end portion to a lower end portion, a second arc-shaped guiding portion for guiding the process cartridge toward the mounted position, arranged on said second frame, said second arc-shaped guiding portion extending from an upper end portion to a lower end portion, a first concave portion for positioning the process cartridge, arranged on said first frame and being in a row with said first arc-shaped guiding portion, and a second concave portion for positioning the process cartridge, arranged on said second frame and being in a row with said second arc-shaped guiding portion;

(b) an exterior cover arranged on the exterior of said frame;

(c) a closing cover being configured for opening and closing relative to said exterior cover;

(d) elastic means for elastically urging the process cartridge to said first concave portion and said second concave portion, said elastic means being arranged on said closing cover;

(e) drive transmission means for transmitting a driving force to the process cartridge mounted in the mounted position;

(f) optical means for illuminating the electrophotographic photosensitive member of the process cartridge mounted in the mounted position with information light;

(g) a transfer roller for transferring a toner image formed on the electrographic photosensitive member of the process cartridge mounted in the mounted position onto the recording medium; and (h) conveying means for conveying the recording medium through said frame, said frame comprising (i) integrally-formed optical holding means for fixedly holding said optical means above the lower end portions of said first and second arc-shaped guiding portions, (ii) integrally-formed transfer holding means for fixedly holding said transfer roller below the lower end portions of said first-and second arc-shaped guiding portions, (iii) integrally-formed guiding means for guiding the recording medium from a paper supply to said transfer roller, (iv) integrally-formed fixing holding means for fixedly holding fixing means for fixing an image on the recording medium, and (v) integrally-formed discharge guiding means for guiding the recording medium from the fixing means to a discharge tray.

12. An apparatus according to claim 11, wherein each of said first and second arc-shaped guiding portions is curved toward a lower portion of a body of said image forming apparatus.

13. An apparatus according to claims 11 or 12, wherein each of said first and second arc-shaped guiding portions comprises a guide groove which couples an insertion portion of the process cartridge with the mounted position in an arc which is convex downward.

14. An apparatus according to claim 11, wherein said optical means has a mirror disposed above said first and second arc-shaped guiding portions.

15. An apparatus according to claims 11 or 14, wherein said transfer roller is disposed below said first and second arc-shaped guiding portions.

16. An apparatus according to claim 11, wherein said drive transmission means comprises a driving gear, and said driving gear meshes with a gear of the process cartridge.

17. An apparatus according to claim 11, wherein the process cartridge mounted to the mounted position is supported at least in part by said first and second arc-shaped guiding portions.

18. An image forming apparatus for forming an image on a recording medium, comprising:

optical means;

a process cartridge having an image bearing member;

process means for processing an image on said image bearing member, said process means comprising transfer means for transferring an image from said image bearing member to recording material; and an image forming apparatus body usable with said process cartridge, said image forming apparatus body comprising an integrally formed frame having an arc-shaped guiding portion formed therein for guiding said process cartridge toward a mounted position, said arc-shaped guiding portion extending from an upper end portion to a lower end portion, said frame comprising (i) integrally-formed optical holding means for fixedly holding said optical means above the lower end portion of said arc-shaped guiding portion, (ii) integrally-formed transfer holding means for fixedly holding said transfer means below the lower end portion of said arc-shaped guiding portion, (iii) integrally-formed guiding means for guiding the recording medium from a paper supply to said transfer means, (iv) integrally-formed fixing holding means for fixedly holding fixing means for fixing an image on the recording medium, and (v) integrally-formed discharge guiding means for guiding the recording medium from the fixing means to a discharge tray, said image forming apparatus body further comprising conveying means for conveying the recording medium, wherein said process cartridge is guided to the mounted position by said arc-shaped guiding portion when mounted on said frame, and wherein said optical means has the same position relative to said arc-shaped guiding portion during image formation and during insertion and removal of said process cartridge.

19. An image forming apparatus according to claim 18, wherein said process cartridge is guided toward the mounted position by said arc-shaped guiding portion, and a shaft of a photosensitive drum serving as said image bearing member is guided by said arc-shaped guiding portion.

20. An image forming apparatus according to claim 18, wherein a protruding portion protruding from said process cartridge is guided by said arc-shaped guiding portion toward the mounted position.

21. An image forming apparatus according to claim 20, wherein the protruding portion protrudes from a frame of the process cartridge in a direction coaxial with an axis of an electrophotographic photosensitive drum of the process cartridge.

22. An image forming apparatus according to claim 18, wherein said process cartridge is mounted to the mounted position from a direction perpendicular to a direction in which a shaft of said image bearing member extends.

23. An image forming apparatus according to claims 18 or 20, wherein the mounted position has a positional groove, and the positional groove is coupled to said arc-shaped guiding portion.

24. An image forming apparatus according to claim 23, wherein said arc-shaped guiding portion is curved toward a lower portion of said image forming apparatus body.

25. An image forming apparatus according to claim 24, wherein said arc-shaped guiding portion comprises a guide groove which couples an insertion portion of said process cartridge with the mounted position in an arc which is convex downward.

26. An image forming apparatus according to claim 25, wherein a mirror of said optical means is disposed above said arc-shaped guiding portion.

27. An image forming apparatus according to claim 18, wherein said process cartridge is mounted to the mounted position by engagement of a shaft of a photosensitive drum serving as said image bearing member with a positional groove of the mounted position.

28. An image forming apparatus according to claim 18, wherein said arc-shaped guiding portion is curved toward a lower portion of said image forming apparatus body.

29. An image forming apparatus according to claims 18 or 28, wherein said arc-shaped guiding portion comprises a guide groove which couples an insertion portion of said process cartridge with the mounted position in an arc which is convex downward.

30. An image forming apparatus according to claim 29, wherein a mirror of said optical means is disposed above said arc-shaped guiding portion.

31. An image forming apparatus according to claim 18, wherein said process cartridge mounted to the mounted position is supported at least in part by said arc-shaped guiding portion.

32. An image forming apparatus according to claim 18, wherein said process cartridge is mounted to the mounted position with a shaft of a photosensitive drum, serving as said image bearing member, supported by a positional groove in the mounted position and with a protruding portion protruding from an outer frame of said process cartridge supported by said arc-shaped guiding portion.

33. An image forming apparatus according to claim 18, wherein said process cartridge mounted in the mounted position is pressed to the mounted position by a spring provided on said image forming apparatus body.

34. An image forming apparatus according to claim 18, wherein said process means includes developing means.

35. An image forming apparatus according to claim 18, wherein said process means includes cleaning means.

36. An image forming apparatus according to claim 18, wherein said process means includes charging means.

37. An image forming apparatus according to claim 18, wherein a mirror of said optical means is disposed above said arc-shaped guiding portion.

38. An image forming apparatus, to which a process cartridge is detachably mountable, the process cartridge having an image bearing member and process means actable on the image bearing member, for forming an image on a recording medium, said image forming apparatus comprising:

an integrally-formed frame having an arc-shaped guiding portion formed in said frame for guiding the process cartridge toward a mounted position in said frame, said arc-shaped guiding portion extending from an upper end portion to a lower end portion;

drive transmission means for transmitting a driving force to the process cartridge mounted in the mounted position;

optical means for illuminating the image bearing member of the process cartridge mounted in the mounted position with information light, wherein said optical means has the same position relative to said arc-shaped guiding portion during image formation and during insertion and removal of the process cartridge;

transfer means for transferring a toner image formed on the image bearing member of the process cartridge mounted in the mounted position onto the recording medium; and conveying means for conveying the recording medium through said frame, said frame comprising (i) integrally-formed optical holding means for fixedly holding said optical means above the lower end portion of said arc-shaped guiding portion, (ii) integrally-formed transfer holding means for fixedly holding said transfer means below the lower end portion of said arc-shaped guiding portion, (iii) integrally-formed guiding means for guiding the recording medium from a paper supply to said transfer means, (iv) integrally-formed fixing holding means for fixedly holding fixing means for fixing an image on the recording medium, and (v) integrally-formed discharge guiding means for guiding the recording medium from the fixing means to a discharge tray.

39. An image forming apparatus according to claim 38, wherein the process cartridge is guided toward the mounted position by said arc-shaped guiding portion, and a shaft of a photosensitive drum serving as the image bearing member is guided by said arc-shaped guiding portion.

40. An image forming apparatus according to claim 38, wherein a protruding portion protruding from the process cartridge is guided by said arc-shaped guiding portion toward the mounted position.

41. An image forming apparatus according to claim 40, wherein the protruding portion protrudes from a frame of the process cartridge in a direction coaxial with an axis of an electrophotographic photosensitive drum of the process cartridge.

42. An image forming apparatus according to claims 38 or 40, wherein the mounted position has a positional groove, and the positional groove is coupled to said arc-shaped guiding portion.

43. An image forming apparatus according to claim 42, wherein said arc-shaped guiding portion is curved toward a lower portion of said image forming apparatus body.

44. An image forming apparatus according to claim 43, wherein said optical means has a mirror disposed above said arc-shaped guiding portion.

45. An image forming apparatus according to claim 44, wherein said transfer means is disposed below said arc-shaped guiding portion.

46. An image forming apparatus according to claim 38, wherein said arc-shaped guiding portion is curved toward a lower portion of the image forming apparatus body.

47. An image forming apparatus according to claims 38 or 46, wherein said optical means has a mirror disposed above said arc-shaped guiding portion.

48. An image forming apparatus according to claim 38, wherein said arc-shaped guiding portion comprises a guide groove which couples an insertion portion of the process cartridge with the mounted position in an arc which is convex downward.

49. An image forming apparatus according to claim 38, wherein the process cartridge mounted to the mounted position is supported by said arc-shaped guiding portion.

50. An image forming apparatus according to claim 38, wherein the process cartridge is mounted to the mounted position with a shaft of a photosensitive drum, serving as the image bearing member, supported by a positional groove in the predetermined mounted position and with a protruding portion protruding from an outer frame of the process cartridge supported by said arc-shaped guiding portion.

51. An image forming apparatus according to claim 38, wherein said transfer means is disposed below said arc-shaped guiding portion.

52. An image forming apparatus according to claim 38, wherein said transfer means comprises a transfer roller.

53. An image forming apparatus according to claim 38, wherein said drive transmission means has a driving gear, and said driving gear meshes with a gear of the process cartridge.

54. An image forming apparatus according to claim 38, wherein said optical means has a laser scanner and a mirror.

55. An image forming apparatus according to claim 38, further comprising the process cartridge wherein said process cartridge includes:

an outer frame; and a protruding portion integrally formed with and protruding from said frame configured to engage said arc-shaped guiding portion formed in said image forming apparatus frame, when said process cartridge is mounted on said image forming apparatus.

56. An image forming apparatus according to claim 55, wherein said protruding portion comprises a shaft of a photosensitive drum serving as said image bearing member.

57. An image forming apparatus according to claim 55, wherein said process means includes developing means.

58. An image forming apparatus according to claim 55 or 57, wherein said process means includes cleaning means.

59. An image forming apparatus according to claim 58, wherein said process means includes charging means.

60. An image forming apparatus according to claim 55, wherein said process means includes charging means.

61. An image forming apparatus according to claim 55, wherein said protruding portion protrudes from said outer frame in a direction coaxial with an axis of said image bearing member.

62. An image forming apparatus according to claim 55, further comprising another arc-shaped guiding portion formed in said integrally-formed frame and another protruding portion protruding from said outer frame and being configured to engage said another arc-shaped guiding portion when said process cartridge is mounted on said image forming apparatus.

63. An image forming apparatus according to claim 38, further comprising the process cartridge, wherein said process cartridge includes:

a cartridge frame;

an electrophotographic photosensitive drum as said image bearing member;

process means actable on said electrophotographic photosensitive drum; and a protruding portion protruding from said cartridge frame in a direction coaxial with an axis of said electrophotographic photosensitive drum, configured to engage said arc-shaped guiding portion when said process cartridge is mounted on a main body of said image forming apparatus.

64. An image forming apparatus according to claim 63, wherein said process means comprises developing means for developing a latent image formed on said electrophotographic photosensitive drum.

65. An image forming apparatus according to claims 63 or 64, wherein said process means comprises charging means for charging said electrophotographic photosensitive drum.

66. An image forming apparatus according to claim 65, wherein said process means comprises cleaning means for removing residual developer from said electrophotographic photosensitive drum.

67. An image forming apparatus according to claim 63, wherein said process means comprises cleaning means for removing residual developer from said electrophotographic photosensitive drum.

68. An image forming apparatus according to claim 63, further comprising another arc-shaped guiding portion formed in said integrally-formed frame and another protruding portion protruding from said cartridge frame and being configured to engage said another arc-shaped guiding portion when said process cartridge is mounted on said main body of said image forming apparatus.

69. An image forming apparatus according to claim 38, further comprising the process cartridge, wherein said process cartridge includes:

a cartridge frame;

an electrophotographic photosensitive drum as said image bearing member;

developing means as said process means for developing a latent image formed on said electrophotographic photosensitive drum;

charging means as said process means for charging said electrophotographic photosensitive drum;

cleaning means as said process means for removing residual developer from said electrophotographic photosensitive drum; and a protruding portion protruding from said cartridge frame in a direction coaxial with an axis of said electrophotographic photosensitive drum, configured to engage said arc-shaped guiding portion, when said process cartridge is mounted on a main body of said image forming apparatus.

70. An image forming apparatus according to claim 69, further comprising another arc-shaped guiding portion formed in said integrally-formed frame and another protruding portion protruding from said cartridge frame and being configured to engage said another arc-shaped guiding portion when said process cartridge is mounted on said main body of said image forming apparatus.

71. An image forming apparatus including a process cartridge having an image bearing member and process means actable on the image bearing member, for forming an image on a recording medium, said image forming apparatus comprising:

an integrally-formed frame having an arc-shaped guiding portion formed in said frame for guiding the process cartridge toward a mounted position in said frame, said arc-shaped guiding portion extending from an upper end portion to a lower end portion;

a drive transmission transmitting a driving force to the process cartridge mounted in the mounted position;

an optical system for illuminating the image bearing member of the process cartridge mounted in the mounted position with information light, wherein said optical system has the same position relative to said arc-shaped guiding portion during image formation and during insertion and removal of the process cartridge;

a transferor for transferring a toner image formed on the image bearing member of the process cartridge mounted in the mounted position onto the recording medium; and a conveyor conveying the recording medium through said frame, said frame comprising (i) an integrally-formed optical holder means for fixedly holding said optical system above the lower end portion of said arc-shaped guiding portion, (ii) an integrally-formed transfer holder means for fixedly holding said transferor below the lower end portion of said arc-shaped guiding portion, (iii) an integrally-formed guide guiding the recording medium from a paper supply to said transferor, (iv) an integrally-formed fixing holder means for fixedly holding a fixer fixing an image on the recording medium, and (v) an integrally-formed discharge guide guiding the recording medium from the fixer to a discharge tray, wherein said process cartridge comprises:

a cartridge frame;

an electrophotographic photosensitive drum as said image bearing member;

a developing means as said process means for developing a latent image formed on said electrophotographic photosensitive drum;

a charging means as said process means for charging said electrophotographic photosensitive drum;

a cleaning means as said process means for removing residual developer from said electrophotographic photosensitive drum; and a protruding portion protruding from said cartridge frame in a direction coaxial with an axis of said electrophotographic photosensitive drum, configured to engage said arc-shaped guiding portion provided on the frame of said image forming apparatus, when said process cartridge is mounted on a main body of said image forming apparatus.

72. An image forming apparatus according to claim 71, further comprising another arc-shaped guiding portion formed in said integrally-formed frame and another protruding portion integrally formed with said cartridge frame and protruding from said cartridge frame and being configured to engage said another arc-shaped guiding portion when said process cartridge is mounted on said main body of said image forming apparatus.

73. An image forming apparatus according to claim 47, wherein said transfer means is disposed below said arc-shaped guiding portion.

* * * * *

UNITED STATES PATENT AND TRADEMARK OFFICE

CERTIFICATE OF CORRECTION

PATENT NO. : 5,543,891

DATED : August 6, 1996

INVENTOR(S) : TAKESHI SETORIYAMA

It is certified that error appears in the above-indentified patent and that said Letters Patent is hereby corrected as shown below:

COLUMN 2:

Line 49, "tranfer" should read --transfer--.

COLUMN 5:

Line 54, "apparatus-by" should read --apparatus by--.

COLUMN 10:

Line 15, "electrographic" should read --electrophotographic--; and
Line 26, "first-and" should read --first and--.

Signed and Sealed this

Twenty-fifth Day of February, 1997

*Attest:*

*Attesting Officer*

BRUCE LEHMAN

*Commissioner of Patents and Trademarks*